US006850071B1

(12) United States Patent
Pederson et al.

(10) Patent No.: US 6,850,071 B1
(45) Date of Patent: Feb. 1, 2005

(54) SPARK MONITOR AND KILL CIRCUIT

(75) Inventors: Neal R. Pederson, Los Alamos, NM (US); Bernie C. Thompson, Albuquerque, NM (US); James M. Potter, Los Alamos, NM (US)

(73) Assignee: Automotive Test Solutions, Inc., Los Alamos, NM (US)

( * ) Notice: Subject to any disclaimer, the term of this patent is extended or adjusted under 35 U.S.C. 154(b) by 0 days.

(21) Appl. No.: 10/651,326

(22) Filed: Aug. 28, 2003

(51) Int. Cl.[7] ..... F02P 17/00

(52) U.S. Cl. ..... 324/396; 324/397; 324/399; 324/402; 123/406.13; 123/198 DC

(58) Field of Search ..... 324/378–402; 123/406.11, 406.12, 406.13, 198 DC

(56) References Cited

U.S. PATENT DOCUMENTS 5,224,015 A * 6/1993 Balland ..... 361/256
5,301,644 A * 4/1994 Olmr ..... 123/198 DB
5,933,009 A 8/1999 Kayser ..... 324/399
6,222,368 B1 * 4/2001 Inagaki et al. ..... 324/399
6,348,797 B1 * 2/2002 Shimizu et al. ..... 324/399
6,426,626 B1 7/2002 Kravis ..... 324/378

* cited by examiner

*Primary Examiner*—Vincent Q. Nguyen
(74) *Attorney, Agent, or Firm*—Matthew S. Wermager

(57) ABSTRACT

The method and apparatus of the present invention are useful for the monitoring of the electrical signals within an internal combustion spark plug circuit and the killing of a spark plug within that circuit. The invention essentially consists of connecting a transformer to the high voltage side of the spark plug circuit. Through the use of impedance and inductance, the present invention can either produce a low voltage replica of the waveform of the high voltage electrical signal which is directed to a spark plug or can effectively prohibit that spark plug from firing by short circuiting the low voltage side of the transformer of the device.

15 Claims, 4 Drawing Sheets

SPARK MONITOR AND KILL CIRCUIT

FIELD OF THE INVENTION

The present invention relates generally to the field of electrical diagnostic devices. More specifically, the present invention relates to the field of devices for diagnosing problems within an ignition circuit of an internal combustion engine. The present invention allows for the monitoring and disabling of a single spark plug within an ignition circuit. The monitoring function can be accomplished without affecting the performance of the other spark plugs or the engine as a whole, and the disabling function can be accomplished without affecting the performance of any of the other spark plugs.

BACKGROUND OF THE INVENTION

Diagnosing the performance or mis-performance of an internal combustion engine often requires a technician to monitor the performance of each spark plug in that engine. However, the modern internal combustion engine has been transformed from a basically mechanical device into one that is significantly technologically advanced. Additionally, one of the most effective methods of diagnosing a problem within an internal combustion engine is to analyze the waveform of the voltage that is carried through the electrical circuit attached to the spark plugs. However, it is becoming exceedingly difficult to access this circuit without significant time and expenditure. For example, more modern internal combustion engine ignition systems incorporate an ignition module (ignition switching device) into the ignition coil assembly, which makes accessing the primary winding on the ignition coil impossible. Additionally, the voltage on the secondary winding side of the ignition coil can reach extremely high values (e.g. 65,000 V), making it not only unsafe to attempt to access these voltages, but would instantaneously destroy any conventional oscilloscope if connected without the use of specialized and expensive adaptors.

While observing and analyzing the waveform of the electrical impulse which is directed at each spark plug is useful in identifying many of the problems within an internal combustion engine, it may also be desirable to short or disable a single spark plug within the engine in order to diagnose a weak cylinder. The traditional method of identifying a weak cylinder is to disable one spark plug at a time while an engine is idling. If a cylinder is disabled by disabling the spark plug, and there is no corresponding change in idling speed, the weak cylinder has been identified. However, in many of the newer ignition systems, the spark plug is often recessed into the engine head, preventing access to the plug itself without undue labor and expense.

Thus, what is needed is a safe and cost effective way of both monitoring the performance of a spark plug within an ignition circuit while having the capability to disable that spark plug for further diagnosis.

There have been previous attempts to solve this problem. For example, U.S. Pat. No. 5,933,009 to Kayser discloses a spark plug engine analyzing device and method. Kayser essentially attempts to overcome the problems addressed above by inserting two resistors, having a resistance ratio of 1000 to 1, along the electrical path of the high voltage said of the secondary winding. This will effectively reduce the voltage by a factor of 1000. This voltage is then inputted into a solid state device whose output is a processed waveform which can be displayed on an oscilloscope. The disadvantage of the invention of Kayser is the need to process the reduced voltage signal with a network of resistors and capacitors called a compensated voltage divider before the waveform can be displayed by an oscilloscope. The required processing, wherein half of the signals communicated to the processor are inverted, not only requires two output channels such that all of the signals from the circuit can be observed, but also eliminates the possibility of all of the signals being viewed simultaneously on one oscilloscope or other observation device. In addition, by virtue of the fact that the device of Kayser is not grounded to the vehicle, it would be impossible for the device to short a spark plug.

Another attempt at solving the foregoing problem is disclosed in U.S. Pat. No. 6,426,626 to Kravis. However, this device is limited to analyzing problems within a spark plug or ignition coil itself. In the invention of Kravis, an external power source is used to supply power to an engine's ignition coil. Because an external power source is used without an operating engine, it cannot be used to analyze any problems associated with an operating engine, such as air fuel mixture problems, pre-ignition problems, misfire problems, power train control module problems, ignition wire problems etc. Furthermore, there is no method disclosed for disabling a spark plug.

Therefore what is needed is a device and method for both analyzing the waveform of an spark plug circuit on the high voltage side of an ignition coil which can display the waveform without solid state processing, which can alter the waveform, or can alternatively disable, or short, individual spark plugs.

OBJECTS OF THE INVENTION

It is one object of the present invention to provide for a device used in the diagnosis of problems within an internal combustion engine.

It is another object of the present invention to provide for a device capable of shorting a single spark plug within an internal combustion engine without affecting the performance of the other spark plugs or engine as a whole.

It is yet another object of the present invention to provide for an apparatus that can be attached to the secondary (high voltage) circuit within a spark plug circuit at multiple access points without requiring the disassembly of multiple engine components.

It is still another object of the present invention to produce a low voltage replica of the waveform within the high voltage side of a spark plug circuit without disturbing the spark plug voltage pulse.

SUMMARY OF THE INVENTION

The present invention is an apparatus and method for diagnosing problems within an internal combustion engine. Because a spark plug operates at extremely high voltages, it is either dangerous or expensive to conduct diagnostic testing within this high voltage circuit. Furthermore, accessing the low voltage side of a spark plug circuit is becoming prohibitively expensive as this circuit can only be accessed, in some engines, after significant labor. The present invention, through the use of a transformer, such as an ignition coil, allows the technician to analyze the waveform of the high voltage electrical impulse used to cause a spark plug to arc or fire by creating a low voltage replica of that high voltage electrical impulse. By virtue of electrically connecting the secondary winding side of the transformer of the test device to one or many access points within the secondary circuit of the spark plug circuit, the high voltage electrical impulse will create a low voltage replica within the primary winding (low voltage) side of the transformer of the device. The primary winding side of the device can then be attached to an oscilloscope or other appropriate diagnostic device so that the resultant replica waveform can be observed and analyzed.

The present invention will also allow a technician to short circuit a single spark plug within an engine, a procedure which is essential in identifying a weak cylinder. Using the same transformer as discussed above and providing for a short circuit, or switch, on the primary winding (low voltage) side of that transformer provides a low impedance path for the high voltage impulse, thus prohibiting the spark plug from firing. Closing this switch will allow the high voltage electrical impulse to be passed to ground instead of producing a spark across the spark plug gap. Even in series spark plug circuits, the disabling of this one spark plug will not affect the other spark plug on the circuit.

DESCRIPTION OF THE PREFERRED EMBODIMENT

Figure 1:
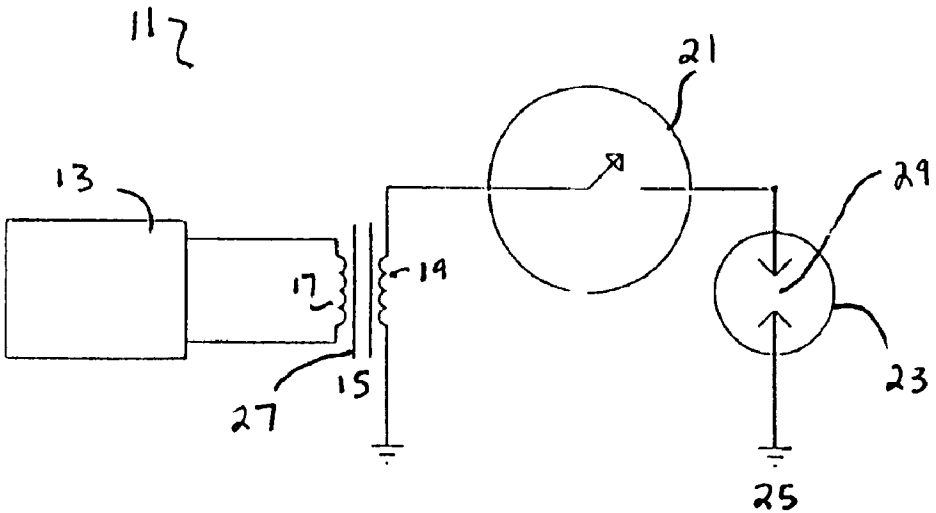
Fig. 1 (Prior Art)
FIG. 1 is a schematic illustration of a conventional spark plug circuit

With reference to FIG. 1, a conventional combustion engine spark plug circuit 11 is comprised of ignition low voltage circuit 13, ignition transformer (ignition coil) 15, distributor 21, spark plug 23 and ground 25. Ignition transformer 15 further includes low voltage winding 17, high voltage winding 19 and iron core 27. In operation, as is well known in the art, ignition low voltage circuit 13 will provide the low voltage power form a battery source (not shown) within ignition low voltage circuit 13, normally 12 volts for an automotive engine but other voltage levels for other types of engines are envisioned. This 12 volt power source is electrically connected to ignition transformer 15. As current flows through low voltage winding 17, a magnetic field develops within iron core 27. Because high voltage winding 19 is also wrapped around iron core 27, the magnetic field couples to this winding as well. So long as current is supplied to low voltage winding 17, the magnetic field around low voltage winding 17 and high voltage winding 19 continues to build. However, once the current to low voltage winding 17 is stopped, there is no force to maintain the magnetic field, which subsequently collapses, thus creating a high voltage electrical impulse. The high voltage developed across the transformer, creates a current within the circuit attached to high voltage winding 19. The method by which the primary current is stopped, as is well known in the art is usually a magnetic reluctance position sensor, a hall effect position sensor or an optical position sensor. This high voltage electrical impulse is directed to distributor 21 whose function is to direct the high voltage circuit to the appropriate spark plugs. With reference to FIG. 1, distributor (whose use is well known in the art) will direct, in this instance, the high voltage current to spark plug 23. When the high voltage electrical impulse reaches spark plug 23, it will create a spark across spark plug gap 29. This spark ignites the fuel within the cylinder of an engine (not shown).

In more modern engines, an electronic control unit ("ECU") (not shown) unilaterally controls the timing of the spark, thus eliminating the need for distributor 21. Regardless of what mechanism is used to control and direct the release of the high voltage from high voltage winding 19, the current invention will function precisely the same.

Figure 2:
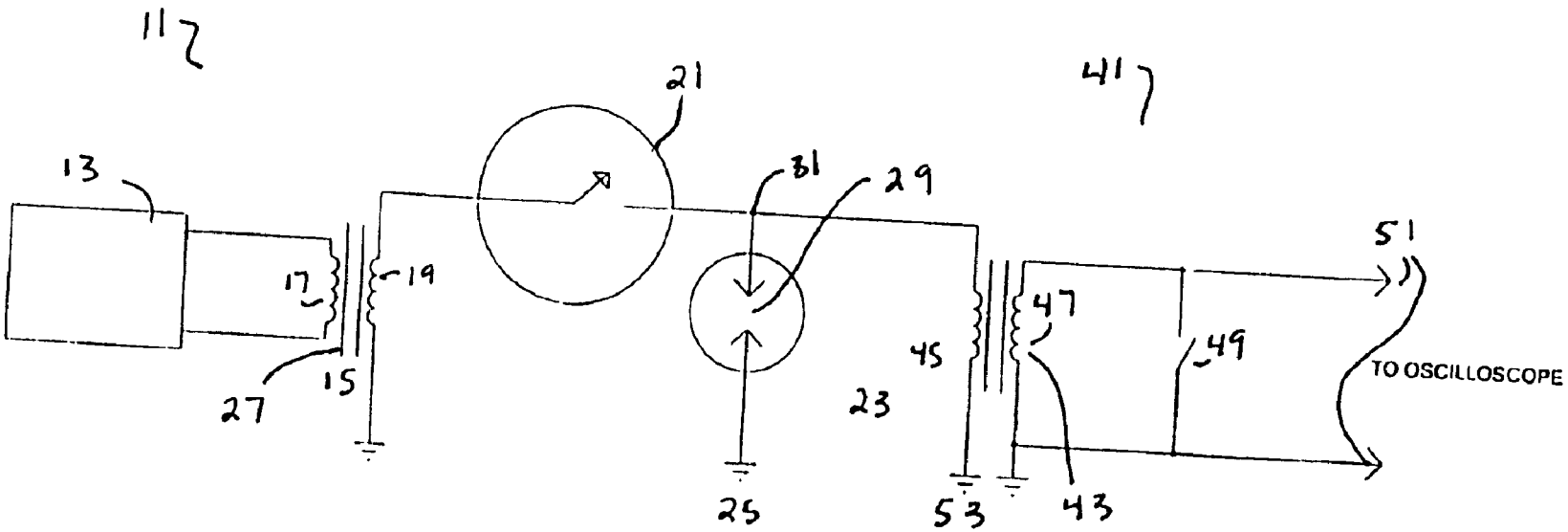
FIG. 2 is a schematic illustration of the conventional spark plug circuit of FIG. 1 with the spark monitor and kill device of the present invention attached.

With reference to FIG. 2, the spark monitor and kill circuit (device) 41 of the present invention, is attached to spark plug circuit 11. As is shown, device 41 is attached between distributor 21 and spark plug 23 at insertion point 31. In alternate embodiments, however, device 41 could be attached directly to the distributor 21, or the spark plug 23, or the ignition transformer 15. Alternatively, in engines where the spark is controlled by an ECU (not shown), the connection could be made at any point of easiest access so long as the connection is made to the circuit connected to the high voltage side of engine transformer 15.

Device 41 consists of a second transformer 43, which again consists of high voltage winding 45 and low voltage winding 47, a kill switch 49, and leads 51 to be attached to an oscilloscope (not shown) or other diagnostic tool(s) such as a peak voltage detector or an LED bar graph display.

The operation of the device depends on the position of kill switch 49. When kill switch 49 is in an open position, device 41 operates to monitor the waveform of spark plug 23 as it is firing. When kill switch 49 is in a closed position, thus completing an electrical circuit, device 41 functions to prohibit spark plug 23 from firing. The monitoring function of device 41 will be discussed first.

With further reference to FIG. 2, device 41 functions to create a low voltage replica of the high voltage electrical impulse which is sent to spark plug 23 from distributor 21. Device 41 includes second transformer 43, which may be identical to engine transformer 15. During this process, kill switch 49 remains in an open position. Once a high voltage current is created in ignition transformer 15 as is discussed with reference to FIG. 1 above, the high voltage current is supplied to spark plug 23 and is of a voltage sufficient to create a spark across gap 29. The connection of device 41 does not impair the ability of spark plug 23 to fire. This is due to the prohibitively high impedance and inductance values of high voltage winding 45. These impendence and inductance values effectively act as resistance, resisting the flow of current through high voltage winding 45, resulting in the high voltage impulse being directed at spark plug 23. However, this high voltage impulse will be reflected onto low voltage winding 47 of transformer 43 as a replica of the voltage waveform in the high voltage circuit. This low voltage waveform replica can then be displayed by an oscilloscope or other diagnostic tool.

The kill function of device 41 is accomplished by closing kill switch 49 attached to the low voltage winding 47 of transformer 43. While kill switch 49 is shown in FIG. 2 as a switch, it can be any device used for completing the circuit, such as a jumper pin or a commonly known relay circuit. Closing kill switch 49 (or any other method of completing the circuit) effectively lowers the impedance of high voltage winding 45 allowing the high voltage electrical impulse to pass to ground 53. Because the high voltage electrical impulse bypasses spark plug 23, it does not fire.

Figure 3:
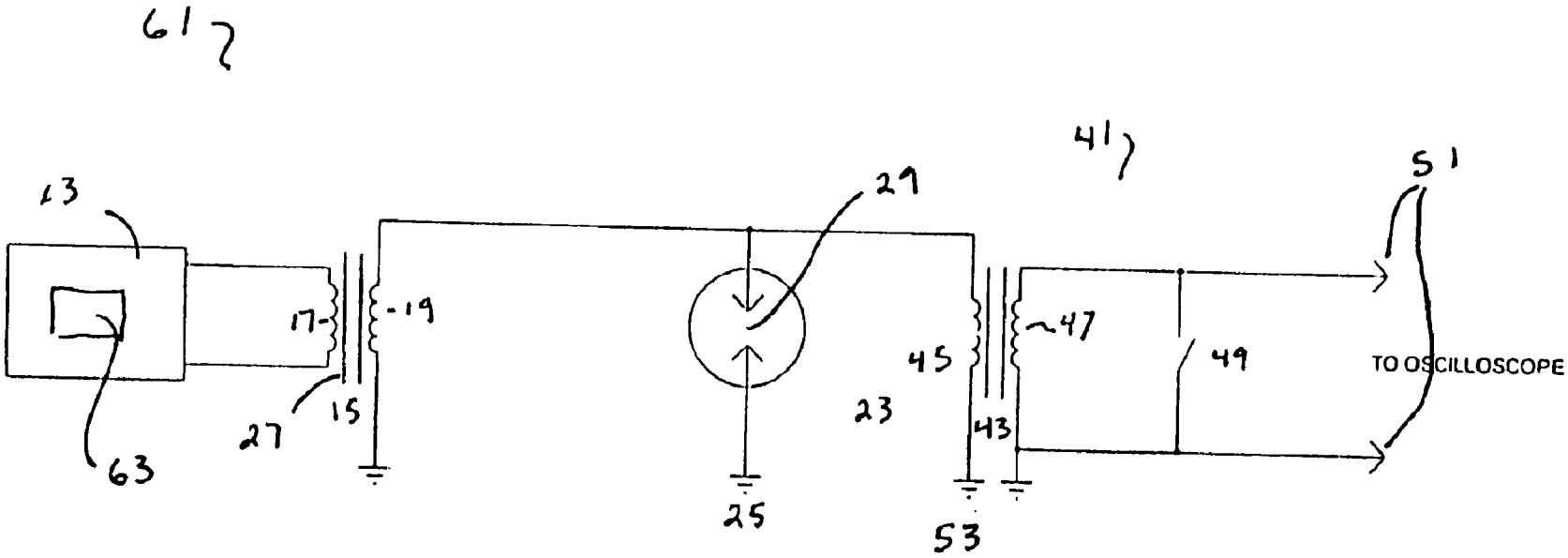
FIG. 3 is a schematic illustration of a spark plug circuit without a distributor with the spark monitor and kill device of the present invention attached.

FIG. 3 illustrates the use of device 41 as attached to spark plug circuit 61 that utilizes an electronic control unit 63 instead of distributor 21 (not shown). In FIG. 3, the electronic control unit is shown as an element of ignition low voltage circuit 13. Device 41 functions precisely the same as in the previous embodiments due to the fact that device 41 is not attached to the circuit until after the high voltage impulse is sent to spark plug 23.

Figure 4:
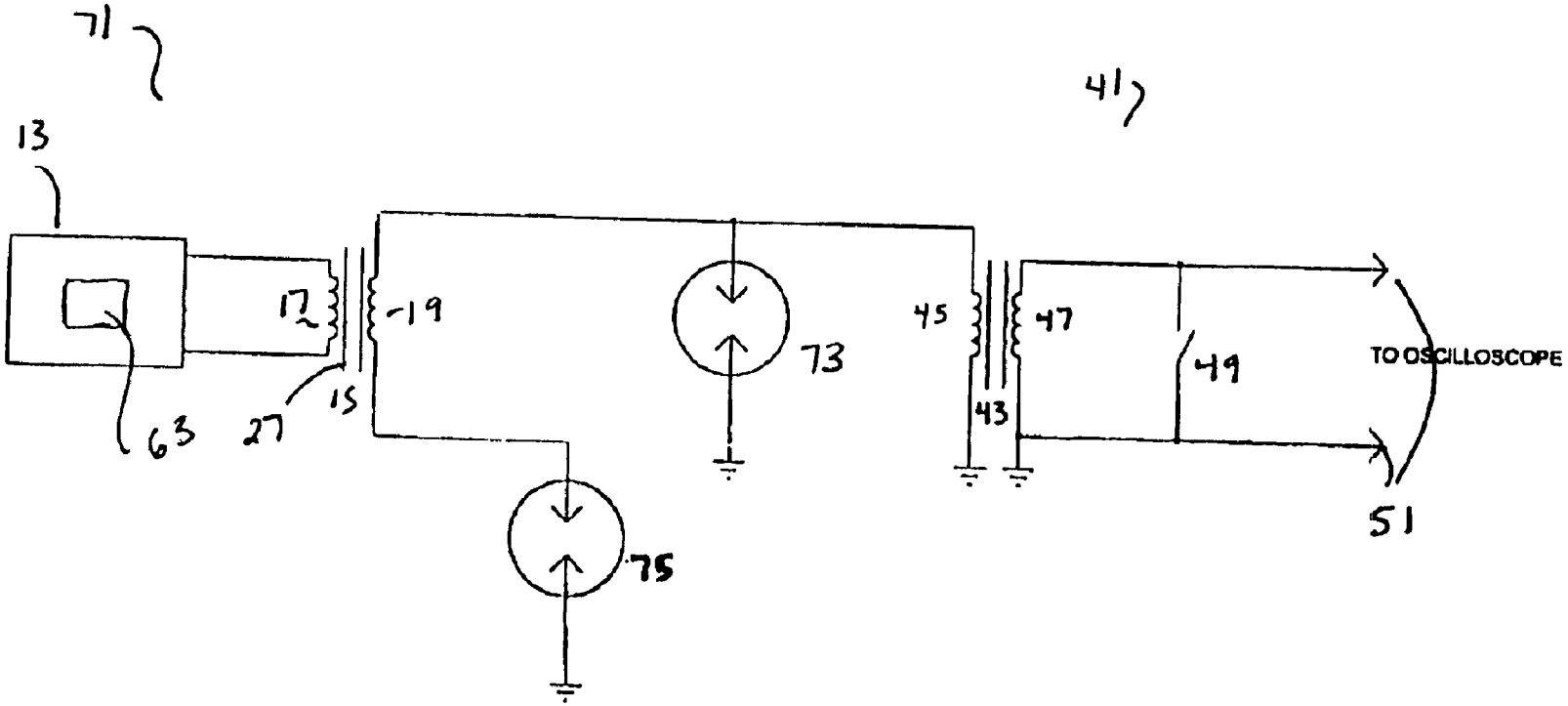
FIG. 4 is a schematic illustration of a series spark circuit with the spark monitor and kill device of the present invention attached.

FIG. 4 illustrates the use of the present invention in a series spark plug circuit 71. Device 41, when attached to series spark plug circuit 71 will only affect the spark plug to which it is attached. As show in FIG. 4, device 41 is attached to spark plug 73 and can either function to monitor or kill spark plug 73. However, spark plug 75 will remain unaffected by the introduction of device 41 into the circuit as it essentially receives a high voltage electrical impulse from high voltage winding 19 that is independent of the impulse sent to spark plug 73.

What is claimed is:

1. An apparatus for shorting a spark plug within an internal combustion engine spark plug circuit, said spark plug circuit including a first low voltage electrical circuit, a power source attached to said first low voltage electrical circuit, a first transforming means attached to said first low voltage electrical circuit and a high voltage electrical circuit, means for generating a high voltage electrical impulse within said high voltage electrical circuit, a spark plug attached to said high voltage electrical circuit, said apparatus for monitoring and shorting comprising:

a. a second transforming means attached to said high voltage electrical circuit and a second low voltage electrical circuit;

b. short circuit means attached to said second low voltage electrical circuit.

2. The apparatus of claim 1, wherein said means for generating a high voltage electrical impulse is selected from the group consisting of a distributor and electronic control unit.

3. The apparatus of claim 2, wherein said means for generating a high voltage electrical impulse is coupled with a switching device, said switching device being selected from the group including a magnetic reluctance position sensor, a hall effect position sensor and an optical position sensor.

4. The apparatus of claim 1 wherein said first transforming means is an ignition coil.

5. The apparatus of claim 1 wherein second transforming means is an ignition coil.

6. The apparatus of claim 1 wherein said shorting means is selected from the group including a jumper wire, a low voltage relay, or a solid state switch.

7. An apparatus for monitoring the performance of an internal combustion engine, said internal combustion engine including a first low voltage electrical circuit, a power source attached to said first low voltage electrical circuit, first transforming means attached to said first low voltage electrical circuit and a high voltage electrical circuit, means for generating a high voltage electrical signal within said high voltage electrical circuit, a spark plug attached to said high voltage electrical circuit, said apparatus for observing comprising:

a. second transforming means attached to said high voltage electrical circuit consisting of a primary winding and a secondary winding;

b. observation means for observing said high voltage electrical signal connected to said primary winding of said second transforming means.

8. The apparatus of claim 7 wherein said means for producing a high voltage electrical impulse is selected from the group consisting of a distributor and electronic control unit.

9. The apparatus of claim 8, wherein said means for generating a high voltage electrical impulse is coupled with a switching device, said switching device being selected from the group including a points, magnetic reluctance position sensor, a Hall Effect position sensor and an optical position sensor.

10. The apparatus of claim 7 wherein said first transforming means is an ignition coil.

11. The apparatus of claim 7 wherein second transforming means is an ignition coil.

12. The apparatus of claim 7 wherein said observation means is an oscilloscope.

13. The apparatus of claim 7 wherein said observation means is any diagnostic device capable of receiving an electronic signal.

14. A method for shorting a single spark plug within an internal combustion, said method comprising the steps of:

a. applying a high voltage electrical impulse to a high voltage electrical circuit containing a spark plug;

b. electrically connecting said high voltage current to a transformer;

c. electrically shorting said low voltage side of said transformer;

d. inducing low impedance in said high voltage electrical circuit with said transformer and said completed low voltage circuit;

e. allowing said high voltage electrical impulse to pass to ground and prohibiting said spark plug from attaining a threshold firing voltage.

15. A method for observing the performance of a spark plug, said method comprising the steps of:

a. applying a source voltage to a transformer;

b. transforming said source voltage current to high voltage current;

c. electrically connecting said high voltage electrical signal to a spark plug;

d. electrically connecting said high voltage current to a second transformer;

e. creating a low voltage replica of said high voltage electrical signal without effectively lowering the voltage of said high voltage;

f. firing said spark plug;

g. displaying the characteristics of said low voltage replica.

* * * * *